US006685880B2

(12) United States Patent
Engström et al.

(10) Patent No.: US 6,685,880 B2
(45) Date of Patent: Feb. 3, 2004

(54) MULTIPLE GRADE CEMENTED CARBIDE INSERTS FOR METAL WORKING AND METHOD OF MAKING THE SAME

(75) Inventors: Lars-Åke Engström, Trångsund (SE); Hélène Ouchterlony, Ingarö (SE)

(73) Assignee: Sandvik Aktiebolag, Sandviken (SE)

( * ) Notice: Subject to any disclaimer, the term of this patent is extended or adjusted under 35 U.S.C. 154(b) by 0 days.

(21) Appl. No.: 09/986,713

(22) Filed: Nov. 9, 2001

(65) Prior Publication Data

US 2002/0059850 A1 May 23, 2002

(30) Foreign Application Priority Data

Nov. 22, 2003 (SE) ..... 0004273

(51) Int. Cl.[7] ..... B22F 7/00; B22F 7/06; B22F 3/12

(52) U.S. Cl. ..... 419/6; 419/6; 419/18; 419/38

(58) Field of Search ..... 419/6, 18, 38

(56) References Cited

U.S. PATENT DOCUMENTS

| | | | | |
|---|---|---|---|---|
| 3,482,295 A | | 12/1969 | Trent | |
| 4,342,594 A | * | 8/1982 | Ettmayer et al. | 75/203 |
| 4,359,335 A | * | 11/1982 | Garner | 75/208 R |
| 4,743,515 A | | 5/1988 | Fischer et al. | |
| 4,971,485 A | | 11/1990 | Nomura et al. | |
| 5,043,123 A | * | 8/1991 | Gormanns et al. | 264/113 |
| 5,264,283 A | * | 11/1993 | Waldenstrom et al. | 428/408 |
| 5,541,006 A | | 7/1996 | Conley | |
| 5,543,235 A | | 8/1996 | Mirchandani et al. | |
| 5,792,403 A | * | 8/1998 | Massa et al. | 264/122 |
| 5,827,570 A | * | 10/1998 | Russell | 427/255 |
| 6,063,333 A | * | 5/2000 | Dennis | 419/6 |
| 6,086,980 A | | 7/2000 | Foster et al. | |

FOREIGN PATENT DOCUMENTS

| | | |
|---|---|---|
| AU | 269598 | 3/1969 |
| DE | 915 570 | 7/1954 |
| DE | 196 34 314 A1 | 1/1998 |
| GB | 1042711 | 9/1966 |
| WO | 88/10163 | 12/1988 |
| WO | 90/02619 | 3/1990 |

* cited by examiner

*Primary Examiner*—Daniel J. Jenkins
(74) *Attorney, Agent, or Firm*—Burns, Doane, Swecker & Mathis, L.L.P.

(57) ABSTRACT

A cemented carbide insert of a first grade has at least one cutting point consisting of a cemented carbide of a second grade with different composition and/or grain size with an uneven transition zone between the first and second grade.

7 Claims, 5 Drawing Sheets

Figure 1:
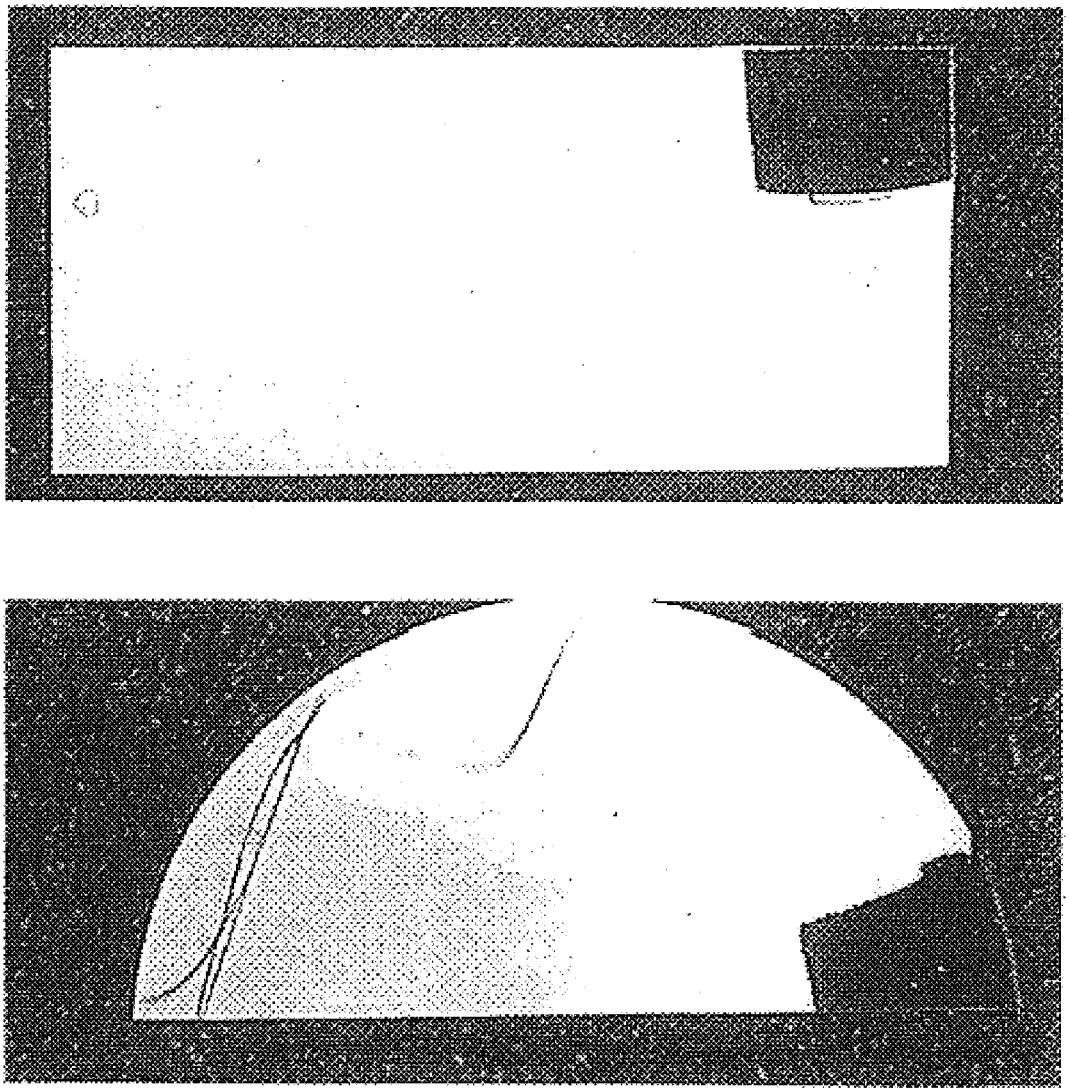

MULTIPLE GRADE CEMENTED CARBIDE INSERTS FOR METAL WORKING AND METHOD OF MAKING THE SAME

FIELD OF THE INVENTION

The present invention relates to multiple grade, composite cemented carbide bodies and a method of making such bodies. The said bodies comprise cemented carbide grades with individually different compositions and/or microstructures and, therefore, correspondingly different properties at different locations in the same body. Such bodies are herein referred to as compound bodies. They are especially aimed at acting as insert in a drill, soldered or by other means attached to a shaft or used as a separate insert in drilling, milling or turning.

BACKGROUND OF THE INVENTION

In the description of the background of the present invention that follows reference is made to certain structures and methods, however, such references should not necessarily be construed as an admission that these structures and methods qualify as prior art under the applicable statutory provisions. Applicants reserve the right to demonstrate that any of the referenced subject matter does not constitute prior art with regard to the present invention.

In tools where the demands on different parts thereof are varying, it is proposed to use compound technique. In drill bits for rock drilling, the demands differ between the surface (wear resistance) and the inner part (toughness) as discussed in U.S. Pat. No. 5,541,006, in which is emphasized on the use of two grades in a rock-drilling bit. The grades are both straight grades with tungsten carbide and Co. Much attention is given the ability to control Co migration, which is in this case preferred to result in an abrupt borderline. This problem is also solved with the technique known as Dual-Phase or DP-technique, U.S. Pat. No. 4,743,515. Tools as wear parts, rolling rings and slitter/trimming knifes can be manufactured with a method described in U.S. Pat. No. 5,543,235, including removing a partitioning means.

The use of two active grades in the same insert is presented in U.S. Pat. No. 3,482,295. The wear resistant grade formed as a top layer on an insert is just around 0.2 mm thick and seems more like an attempt to solve a problem later on solved by the PVD and CVD techniques.

Patents dealing with cemented carbide drills containing cubic carbides are U.S. Pat. No. 6,086,980 and U.S. Pat. No. 4,971,485. The former deals with cylindrical solid tools which are not manufactured by ordinary tool pressing. Also the latter describes a cylindrical tool where the WC-Co grade is used in the shaft to avoid damage due to vibrations in the machine and the shaft is soldered to the cutting part of the tool.

Two or more grades in the same insert is also described in AT 269598 where a method is presented with a number of press stages and using frames of rubber or other elastic materials to form the cavities needed for filling the different powders. AT 269598 thus discloses inserts consisting of two or more cemented carbide grades made by (pre)compacting a blank of one grade provided with groove(s), recess(es) and/or depression(s). These are filled with cemented carbide powder of the other grade and subsequently compacted to a green body which is finally sintered.

DE 19634314 discloses a compound component consisting of at least two constituent parts with different material compositions. At least one of such parts—which are joined into a single component by a concluding sinter process—consists of a hard alloy or a cermet. The joining surface between its constituent parts is an uneven surface.

However, the choice of grades, final compaction pressure and sintering conditions have to be performed with great care in order to avoid cracks developing in the transition region between the two grades. One reason hereto is that it is generally not possible to obtain the optimum compaction pressure to both grades to obtain the same shrinkage. Generally the one grade shrinks more than the other leading to a distorted body after sintering, see FIG. 1. which shows a cross section of an RNGN insert and the same part of the insert from above. That is why AT 269598 discloses a heat treatment after sintering to decrease the stresses at the boundaries. Even if no cracks develop, the body needs excessive grinding in order to be useful as a cutting tool.

SUMMARY OF THE INVENTION

It is therefore an object of the present invention to provide a method of making cemented carbide inserts containing two different cemented carbide grades which are less sensitive to developing cracks in the transition zone between the grades.

It is a further object of the present invention to provide a cemented carbide insert consisting of two different grades which needs less grinding after sintering.

A cemented carbide insert has a first grade of cemented carbide and at least one cutting point of a second grade of cemented carbide, the second grade differing from the first grade in at least one of composition and grain size. A transition zone between the first and second grade is uneven. The cemented carbide of the first grade is a WC-Co grade and the cemented carbide of the second grade is a WC-Co-gamma phase grade.

In one embodiment, method of making a cemented carbide insert of a first grade having at least one cutting point comprising a cemented carbide of a second phase fills a die with a powder of the cemented carbide of the first grade, places a powder of the cemented carbide of the second grade on top of and in a corner of the powder of the first grade, compacts the powder of the cemented carbide of the first grade and the powder of the cemented carbide of the second grade to form a compact, and sinters the compact. The cemented carbide of the second grade differs from the cemented carbide of the first grade in at least one of composition and grain size.

In an additional embodiment, a multi-axial method of making a cemented carbide insert fills a main cavity of a press tool with a cemented carbide powder of a first grade, fills a second cavity of the press tool with a cemented carbide of a second grade, withdraws a lower punch of the main cavity, introduces the cemented carbide of the second grade on top of the cemented carbide powder of the first grade, compacts the powder of the cemented carbide of the first grade and the powder of the cemented carbide of the second grade to form a compact, and sinters the compact. The cemented carbide of the second grade differs from the cemented carbide of the first grade in at least one of composition and grain size.

In a further embodiment, a multi-axial method of making a cemented carbide insert fills a main cavity of a press tool with a cemented carbide powder of a first grade, fills a second cavity of the press tool with a cemented carbide of the second grade, withdraws a lower punch of the main cavity, introduces the cemented carbide of the second grade to push at least a portion of a top portion of the cemented carbide powder of the first grade, the least portion located on a rake face, compacts the powder of the cemented carbide of the first grade and the powder of the cemented carbide of the second grade to form a compact, and sinters the compact. The ratio of a depth of the rake face to a depth of the compact does not exceed 0.5. The cemented carbide of the second grade differs from the cemented carbide of the first grade in at least one of composition and grain size.

BRIEF DESCRIPTION OF THE DRAWING FIGURES

The objects and advantages of the invention will become apparent from the following detailed description of preferred embodiments thereof in connection with the accompanying drawings in which like numerals designate like elements and in which:

FIG. 1 shows a compound insert according to prior art.

FIGS. 2*a–e* illustrates the method of the present invention.

FIGS. 3*a–d* shows cross sections and view from above of RNGN inserts according to the invention.

Figure 4:
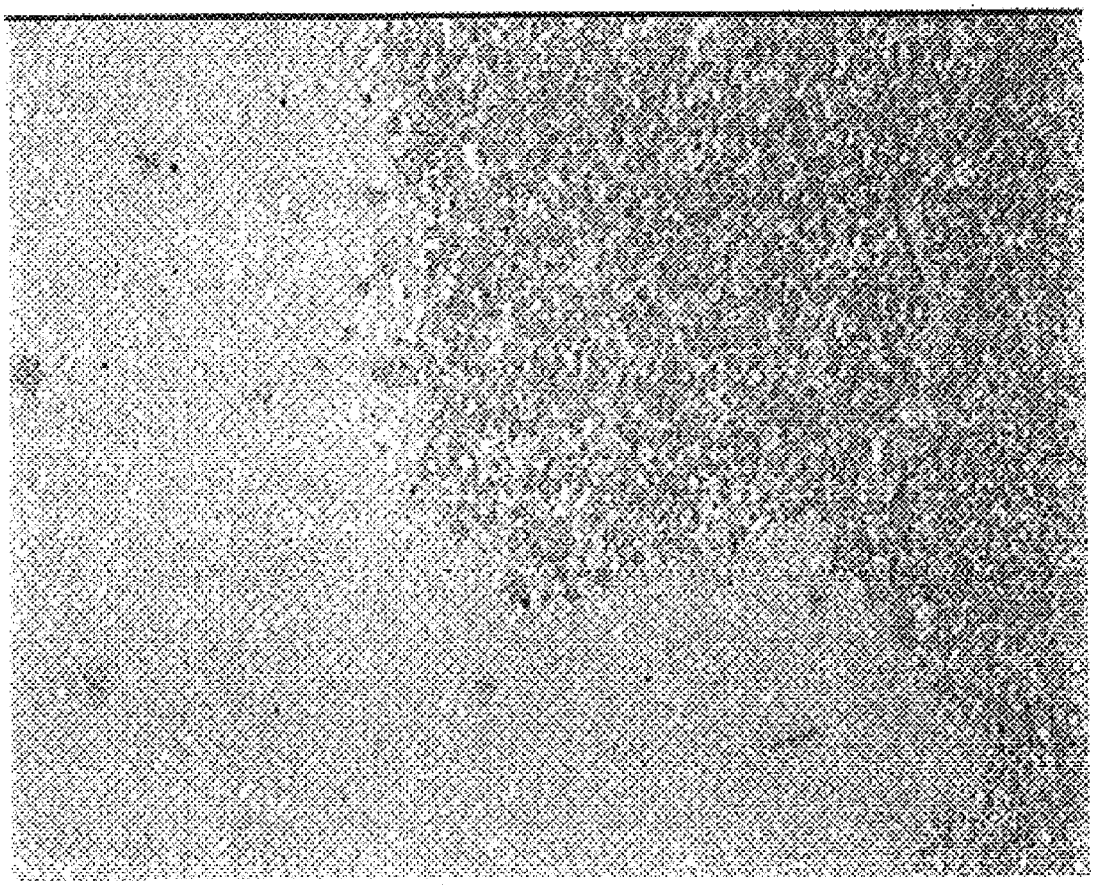

FIG. 4 shows a light optical micrograph at about 1000× of the uneven boundary between the two grades.

DETAILED DESCRIPTION OF THE INVENTION

Figures 2A, 2B, 2C, 2D, 2E:
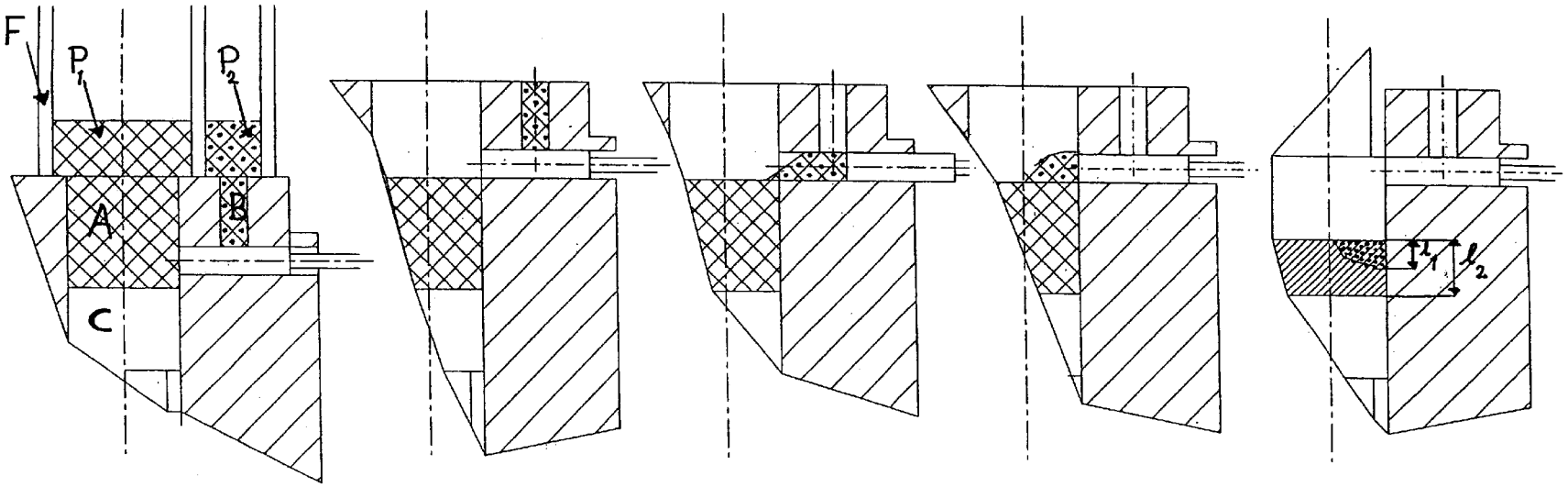
Figure 3A:
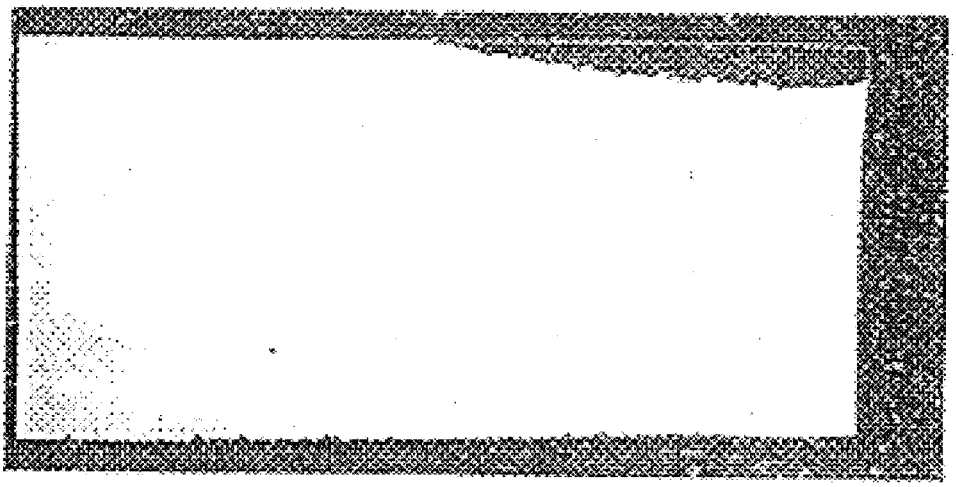
Figure 3C:
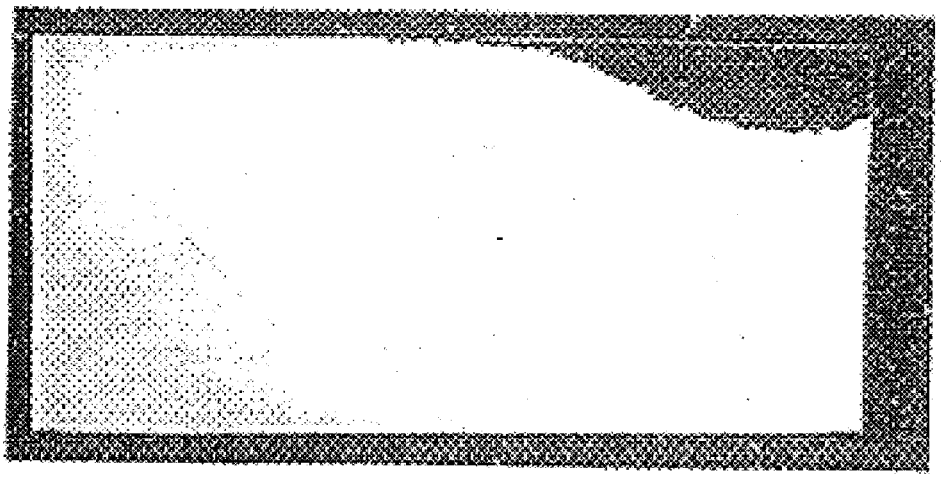
Figure 3B:
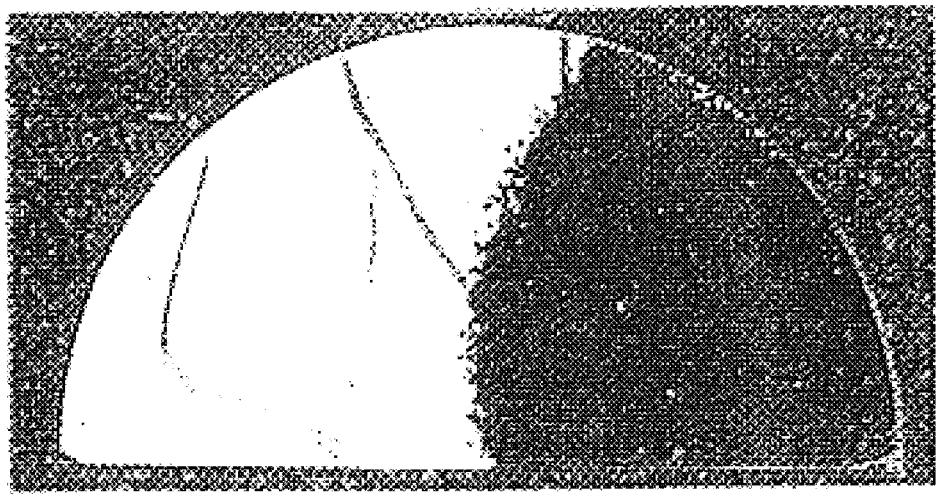
Figure 3D:
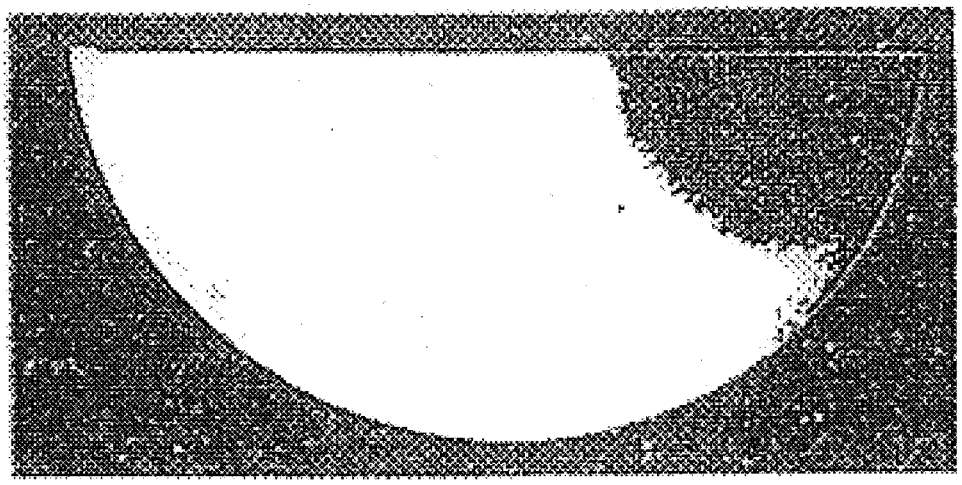

It has now surprisingly been found that the above mentioned problems can be overcome by using a specially designed press tool for making compound cemented carbide inserts. The method is illustrated in FIGS. 2*a–e*. In FIG. 2*a*powder P1 is filled from a filling shoe, F, into the main cavity, A, of the die and powder P2 into an additional cavity, B. In FIG. 2*b* the filling shoe has been withdrawn and the lower punch, C, lowered to a position where the powder P2 can be introduced on top of the powder P1 as shown in FIGS. 2*c* and 2*d*. The resulting insert after compaction and sintering is shown in FIGS. 3*a* and *b*. Alternatively, the level is chosen somewhat higher so that the powder P2 is pushing powder P1 away during introduction and thereby forming a portion deeper on the rake face. The resulting compacted and sintered insert is shown in FIGS. 3*c* and 3*d*. The ratio $1_1/1_2$ in FIG. 2*e* shall not exceed ½.

The multi axial filling procedure allows the two powders to be compacted simultaneously and a compact with more optimal press density is obtained. The sintered body will need very little grinding.

The invention also relates to a cemented carbide insert of a first grade in which at least one cutting point consists of a cemented carbide of a second grade with different composition and/or grain size. Preferably, the first grade is a WC-Co-grade and the second grade a WC-Co-gamma phase grade. The boundary between the first and the second grade after sintering is uneven with no cracks, see FIG. 4. The shape of the bodies of the second grade will always be different within an insert and between inserts.

While the present invention has been described by reference to the abovementioned embodiments, certain modifications and variations will be evident to those of ordinary skill in the art. Therefore, the present invention is to limited only by the scope and spirit of the appended claims.

What is claimed is:

1. A multi-axial method of making a cemented carbide insert, the method comprising the steps of:

providing a press tool with a main cavity, the main cavity having a floor defined by a moveable lower punch;

filling a main cavity of the press tool with a cemented carbide powder of a first grade;

filling a second cavity of the press tool with a cemented carbide of a second grade, the cemented carbide of the second grade differing from the cemented carbide of the first grade in at least one of composition and grain size;

withdrawing the lower punch of the main cavity;

introducing the cemented carbide of the second grade directly on top of the cemented carbide powder of the first grade;

compacting the powder of the cemented carbide of the first grade and the powder of the cemented carbide of the second grade to form a compact; and sintering the compact.

2. A multi-axial method of making a cemented carbide insert having a rake face, comprising the steps of:

providing a press tool with a main cavity, the main cavity having a floor defined by a moveable lower punch;

filling a main cavity of the press tool with a cemented carbide powder of a first grade;

filling a second cavity of the press tool with a cemented carbide of a second grade, the cemented carbide of the second grade differing from the cemented carbide of the first grade in at least one of composition and grain size;

withdrawing a lower punch of the main cavity;

introducing the cemented carbide of the second grade directly onto the cemented carbide powder of the first grade to push at least a portion of a top portion of the cemented carbide powder of the first grade, the portion defining a rake face of the insert;

compacting the powder of the cemented carbide of the first grade and the powder of the cemented carbide of the second grade to form a compact; and sintering the compact.

3. The method of claim 2, wherein a ratio of a depth of the rake face to a depth of the compact does not exceed 0.5.

4. The method of claim 1, wherein the second cavity is axially offset from the main cavity.

5. The method of claim 1, wherein the compacting step is accomplished, at least in part, with axial movement of the lower punch.

6. The method of claim 2, wherein the second cavity is axially offset from the first cavity.

7. The method of claim 2, wherein the compacting step is accomplished, at least in part with axial movement of the lower punch.

* * * * *